US010966890B2

(12) United States Patent
Ramchandran Nair et al.

(10) Patent No.: US 10,966,890 B2
(45) Date of Patent: Apr. 6, 2021

(54) INFANT WARMERS HAVING INTEGRAL BACKUP WARMING BLANKET

(71) Applicant: General Electric Company, Schenectady, NY (US)

(72) Inventors: Santhosh Kumar Ramchandran Nair, Bangalore (IN); Sakthi Narasimhan T, Bangalore (IN); Harry Edward Belsinger, Jr., Laurel, MD (US); Steven Mitchell Falk, Laurel, MD (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/496,588

(22) PCT Filed: Mar. 21, 2018

(86) PCT No.: PCT/US2018/023549
§ 371 (c)(1),
(2) Date: Sep. 23, 2019

(87) PCT Pub. No.: WO2018/175572
PCT Pub. Date: Sep. 27, 2018

(65) Prior Publication Data

US 2020/0315889 A1 Oct. 8, 2020

(30) Foreign Application Priority Data

Mar. 22, 2017 (IN) ..... 201741009933

(51) Int. Cl.
*A61G 11/00* (2006.01)
*A47G 9/02* (2006.01)

(52) U.S. Cl.
CPC ..... *A61G 11/00* (2013.01); *A47G 9/0215* (2013.01); *A61G 2203/46* (2013.01)

(58) Field of Classification Search
CPC ..... A61G 11/00; A61G 11/001; A61G 11/003
(Continued)

(56) References Cited

U.S. PATENT DOCUMENTS 4,712,263 A 12/1987 Pronzinski
5,841,944 A 11/1998 Hutchinson et al.
(Continued)

FOREIGN PATENT DOCUMENTS

CN 103961236 A 8/2014
DE 202011107576 U1 11/2011
(Continued)

OTHER PUBLICATIONS

International Search Report of the International Searching Authority for PCT/US2018/023549 dated Jul. 10, 2018.

*Primary Examiner* — John P Lacyk

(57) ABSTRACT

A warming device configured to warm an infant. The warming device includes a base that supports the infant and an overhead portion that includes an enclosure. An arm is coupled to the base and to the overhead portion. The arm supports the overhead portion above the base. A heating element is operated to generate heat to warm the infant. The overhead portion includes the heating element. A portion of the heat is dissipated into the overhead portion as a waste heat. A warming blanket has a stored state and a deployed state. In the stored state, the warming blanket is at least partially inside the overhead portion. In the deployed state, the warming blanket is outside the overhead portion. The warming blanket is designed to store the waste heat when the warming blanket is in the stored state and to warm the infant when in the deployed state.

20 Claims, 3 Drawing Sheets

(58) Field of Classification Search
USPC ..... 600/21–22
See application file for complete search history.

(56) References Cited

U.S. PATENT DOCUMENTS

| | | | | |
|---|---|---|---|---|
| 6,905,457 | B2 | 6/2005 | Mackin | |
| 2004/0236175 | A1* | 11/2004 | Boone | A61G 10/04 600/22 |
| 2006/0219690 | A1 | 10/2006 | Grinstead et al. | |
| 2010/0261948 | A1* | 10/2010 | Chilton, III | A61G 12/008 600/22 |
| 2016/0270993 | A1 | 9/2016 | Wilden et al. | |

FOREIGN PATENT DOCUMENTS

| | | | |
|---|---|---|---|
| JP | 2016537096 | A | 12/2016 |
| KR | 1020150134745 | A | 12/2015 |

* cited by examiner

INFANT WARMERS HAVING INTEGRAL BACKUP WARMING BLANKET

FIELD

The present disclosure generally relates to infant warming devices, and more particularly to infant warming devices having a backup warming blanket.

BACKGROUND

The Background and Summary are provided to introduce a foundation and selection of concepts that are further described below in the Detailed Description. The Background and Summary are not intended to identify key or essential features of the claimed subject matter, nor are they intended to be used as an aid in limiting the scope of the claimed subject matter.

Infant warmers are frequently used for the medical care of an infant shortly after birth. In general, infant warmers provide supplementary heat for pre-term or full-term infants to support their still-developing thermoregulatory systems.

Modern infant warmers can generate warmth for the infant through radiant heaters, which are electrically powered and positioned to heat the infant from above. For example, GE Healthcare offers such devices, including the Panda Warmer and the Giraffe Warmer. These devices direct radiant heat downwardly towards the infant without interfering with the caregivers' access to provide care for the infant as needed. The devices also include capabilities for monitoring the infant's health, including temperature, weight, SpO2, and pulse rate. As such, the infant warmers provide a warm, comfortable, and developmentally supportive environment for the infant.

SUMMARY

The present disclosure relates to a warming device configured to warm an infant. In one embodiment, the warming device comprises a base configured to support the infant and an overhead portion that includes an enclosure. An arm is coupled to the base and to the overhead portion. The arm supports the overhead portion above the base. A heating element is configured to generate a heat to warm the infant. The overhead portion includes the heating element. During operation of the heating element, a portion of the generated heat is dissipated into the overhead portion as waste heat. The warming device includes a warming blanket having a stored state and a deployed state. In the stored state, the warming blanket is at least partially inside the overhead portion. In the deployed state, the warming blanket is outside the overhead portion. The warming blanket is configured to absorb and store at least a portion of the waste heat when the warming blanket is in the stored state and configured to dissipate the stored waste heat to warm the infant when in the deployed state.

One embodiment relates to a method for warming an infant. The method comprises providing a base configured to support the infant, providing an overhead portion that includes an enclosure, and supporting the overhead portion above the base with an arm that is coupled to the base and to the overhead portion. A heating element is provided within the overhead portion. The heating element is configured to generate heat to warm the infant, wherein a portion of the heat is dissipated into the overhead portion as waste heat. A warming blanket is provided that is positionable in a stored state and in a deployed state. In the stored state, the warming blanket is at least partially inside the overhead portion. In the deployed state, the warming blanket is outside the overhead portion. The warming blanket is configured to absorb and store at least a portion of the waste heat when the warming blanket is in the stored state and configured to dissipate the stored waste heat to warm the infant with the waste heat stored from the heating element when in the deployed state.

Various other features, objects and advantages of the disclosure will be made apparent from the following description taken together with the drawings.

BRIEF DESCRIPTION OF THE DRAWINGS

The drawings illustrate the best mode presently contemplated of carrying out the disclosure. The same numbers are used throughout the drawings to reference like features and like components. In the drawings.

DETAILED DISCLOSURE

This written description uses examples to disclose embodiments of the disclosed invention, including the best mode, and also to enable any person skilled in the art to practice or make and use the same. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Infant warmers have become instrumental tools in supporting the health of an infant in its first moments of life. By directing heat from an overhead source towards the infant, the device helps supplement the infant's still-developing thermoregulatory systems while it adjusts to its new surroundings. However, the present inventor has identified that these essential warming devices are vulnerable for their reliance on consistent, uninterrupted power to produce the radiant energy to warm the infant. As such, this life-preserving technology is often unavailable in the event of a power failure, whether caused by a demand overload, mechanical failures in the hospital or power grid, or weather-related emergencies. While many modern hospitals incorporate emergency backup power sources to maintain power for essential devices during such outages, such backup systems are not readily available in developing regions of the world. Furthermore, these backup systems are themselves susceptible to failure and provide limited service time when available.

Figure 1:
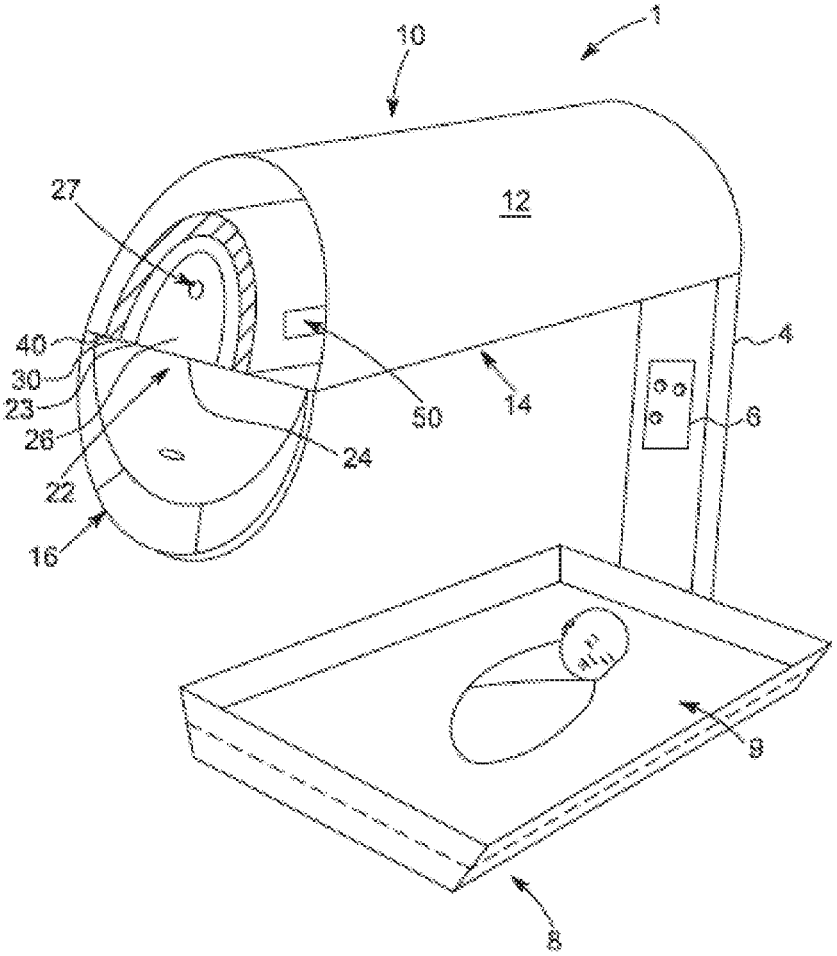
FIG. 1 is an isometric view of an infant warmer in accordance with the present disclosure.

FIG. 1 discloses an infant warmer that further incorporates a backup warming blanket to warm an infant in the event that primary infant warmer is unavailable or inoperable. Specifically, the warming blanket 40 is warmed by harnessing and storing the heat energy that is lost as waste from the infant warmer 1. Once warmed, the warming blanket can be used to warm the infant by placing the infant on top, or by wrapping it around the infant.

The present inventor has determined that approximately 20 to 26 percent of heat energy produced by heating elements within conventional infant warmers is lost. This heat is lost due to conduction and convection of heat from a reflector that is used to reflect the radiant energy from the infrared heating element toward the patient. In other words, about 80 percent of the heat energy produced by the heating element is reflected toward the patient, whereas 20 percent or more of the heat energy is lost to the atmosphere as waste heat.

The present inventor has also identified that this waste energy can be utilized for a useful purpose, such as heating a warming blanket 40 or mattress made of a phase change material (PCM 44). The warming blanket can be used to provide heat for the infant when the infant warmer 1 is inoperable, such as during a power failure.

FIG. 1 discloses one embodiment of an infant warmer 1 in accordance with the present disclosure. The infant warmer 1 is configured to warm an infant resting on a base mattress 9 within a base 8. An overhead portion 10 is supported over the base 8 by an arm 4 such that the overhead portion 10 is positioned above the infant. In the embodiment shown, the controls 6 for operating various functions of the infant warmer 1 are included within the arm 4. The overhead portion 10 includes an enclosure 12 that forms part of the outer surface of the overhead portion 10. An underside 14 defines another part of the outer surface and substantially faces the base 8. A door 16 that is perpendicular to the underside 14 effectively completes the entirety of the outer surface of the overhead portion 10, providing access to the space defined therein.

The overhead portion 10 includes a heating element 20 (shown in FIG. 4) that is configured to generate radiant heat when powered on. A reflector assembly 22 within the overhead portion 10 directs the radiant heat generated by the heating element 20 downwardly toward the base 8 to warm the infant.

FIG. 1 further shows an insulator 30 that rests on the reflector assembly 22 within the overhead portion 10, as well as a warming blanket 40 that rests upon the insulator 30. In the configuration shown, the waste heat that is dissipated from the reflector assembly 22 warms the warming blanket 40 within the overhead portion 10. The thermal resistance between the reflector and phase change material (PCM) 44 of the warming blanket (shown in FIG. 5) is specifically configured to store the maximum amount of energy, while not exceeding temperatures that would burn the baby when the backup warming blanket is in use. In one embodiment, the phase change material of the warming blanket is chosen to not store energy in excess of 40° Celsius in steady state condition. As such, the insulator 30 controls the heat transfer between the reflector assembly 22 and the warming blanket 40.

It should be noted that in some embodiments, it is not necessary or desirable to use an insulator, depending upon the level of heat dissipated from the reflector assembly 22 and absorbed by the warming blanket 40 and the PCM 44 therein.

Figure 2:
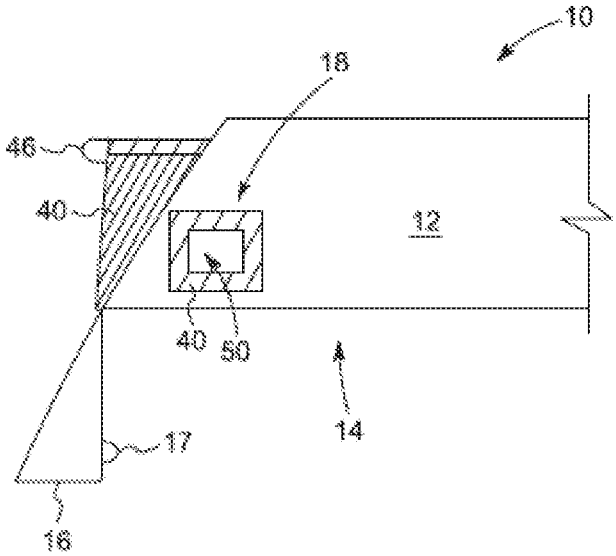
FIG. 2 is a side view of the overhead portion of another embodiment of an infant warmer.

FIG. 2 is a side view of the overhead portion 10, also with the door 16 open. In the embodiment shown, the door 16 is opened with a handle 17. The door 16 may be opened to insert the warming blanket 40 inside the overhead portion 10 to place in a stored state, or to retrieve the warming blanket 40 from the overhead portion 10 to use in a deployed state. In the embodiment shown, the warming blanket 40 includes a tab 46, which can be gripped by a user to remove the warming blanket 40 from the overhead portion 10.

In contrast to the embodiment shown in FIG. 1, the overhead portion 10 of the device in FIG. 2 further includes a window 18 within the enclosure 12. The window 18 allows the user to view the warming blanket 40 inside the overhead portion 10 when the door 16 is closed. FIG. 2 further shows an embodiment of the warming blanket 40 having a temperature module 50 that indicates the temperature of the warming blanket 40. To fully utilize a warming blanket 40 having such a temperature module 50, the window 18 within the enclosure 12 is positioned to align with the temperature module 50. In this manner, the user can also see the temperature module 50 of the warming blanket 40 when one blanket 40 is inside the overhead portion 10, without requiring opening the door 16.

Figure 3:
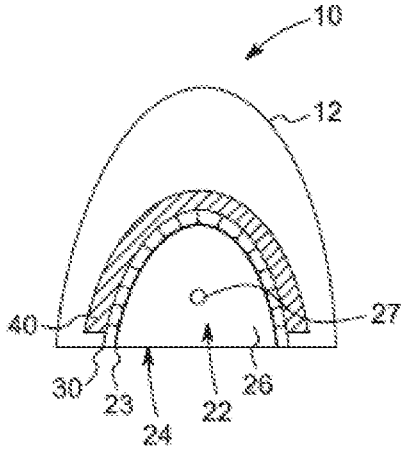
FIG. 3 is a front view of the infant warmer shown in FIG. 1.
Figure 4:
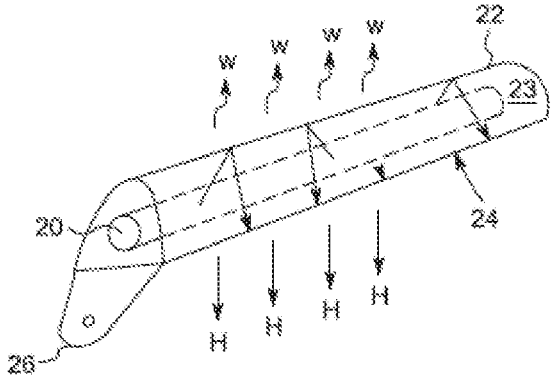
FIG. 4 is an isometric view of a reflector assembly from the infant warmer shown in FIG. 1.

As previously discussed and shown in FIG. 3, the overhead portion 10 includes a reflector assembly 22 to reflect the heat generated by the heating element 20 (discussed further below) downwardly towards the infant. The reflector assembly 22 also has a door 26 with a handle 27 to access the heating element 20 therein, which is shown in FIG. 4. In the embodiment shown, the reflector assembly 22 directs the radiant heat downwardly towards the infant using an arcuate upper portion 23. A lower portion 24, as conventionally known in the art, substantially faces the infant and prevents the infant or a caregiver from directly contacting the heating element 20 from below.

FIG. 4 shows the reflector assembly 22 with the door 26 in an open position. The heating element 20 is contained within the reflector assembly 22 and is typically cylindrically-shaped radiant heater, as shown. As indicated by the arrows, the radiant heat energy generated by the heating element 20 is directed by the upper portion 23 of the reflector assembly 22 downwardly towards the infant as heat H. In addition, as previously discussed above, some portion of the radiant heat energy generated by the heating element 20 is also lost as waste energy through convection, which is shown as waste heat W. By virtue of the reflector assembly 22 being located within the overhead portion 10, this waste heat W is dissipated into the overhead portion 10 and traditionally not used.

Figure 5:
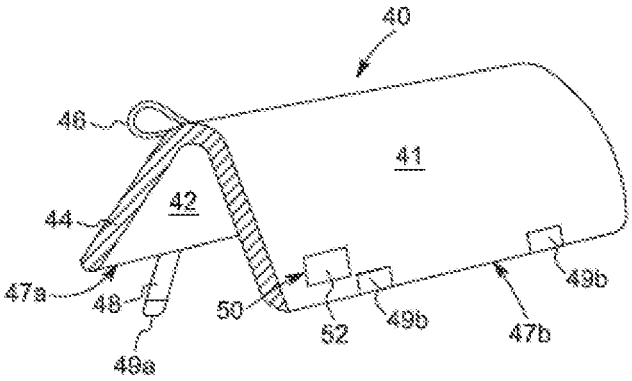
FIG. 5 is an isometric view of a warming blanket in accordance with the present disclosure.

However, the presently disclosed device captures and uses this waste heat W to warm the warming blanket 40, which can be used as a backup device for warming the infant in the event the infant warmer 1 becomes inoperable. FIG. 5 shows one configuration for heating the warming blanket 40 with the waste heat W dissipated into the overhead portion 10. The warming blanket 40 has an upper surface 41, a lower surface 42, and a thickness therebetween. In some embodiments, the upper surface 41 and the lower surface 42 are reversible, whereby the warming blanket 40 may be inserted into the overhead portion 10 with either the upper surface 41 or the lower surface 42 facing upwardly, away from the infant. However, in configurations having a temperature module 50, it is advantageous to orient the warming blanket 40 such that the temperature module 50 is on the upper surface 41 and viewable through the window 18 in the overhead portion 10 as previously discussed.

In the embodiment shown, the temperature module 50 integrally includes a display 52, such as an LCD display, to provide an easily-readable digital readout of the warming blanket 40 temperature. While not presently shown, one of ordinary skill in the art will recognize that the temperature module 50 further includes a thermometer, and in some embodiments, such as one having a display 52, also contains a battery. In some embodiments, the temperature module 50 further comprises a microprocessor and an alarm, such as a sound generator, a light indicator, or some other indication that the temperature of the warming blanket 40 exceeds a threshold limit. In this regard, the caregiver is forewarned that the warming blanket 40 is not presently safe for use.

In the embodiment of FIG. 5, the warming blanket 40 further includes a strap 48 for securing the warming blanket 40 around the infant in use. As shown, the strap 48 is coupled at a first end to a first edge 47*a* of the blanket 40. The strap 48 has a fastener 49*a* on a second end that is opposite of the first end at the opposite end of the strap 48. The fastener 49*a* is configured to be removably coupled with a fastener 49*b* located on a second edge 47*b* of the warming blanket 40. In this regard, the strap 48 holds the warming blanket 40 wrapped around an infant, maximizing the heat transferred to the infant over simply resting the infant on the warming blanket 40. It should be noted that while only one strap 48 is presently shown, other quantities of straps 48, as well as other mechanisms for fastening the strap 48, are anticipated by the present disclosure.

Figure 6:
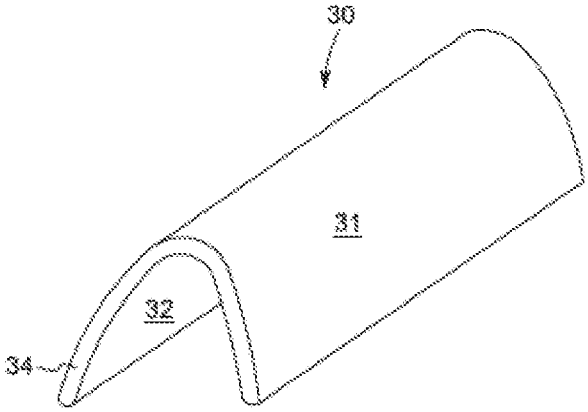
FIG. 6 is an isometric view of an insulator in accordance with the present disclosure.

FIG. 6 discloses one embodiment of an insulator 30 configured to be positioned between the reflector assembly 22 and the warming blanket 40 when the warming blanket 40 is inserted into the overhead portion 10. The insulator 30 has an upper surface 31, a lower surface 32, and is comprised of an insulation material 34. As shown, the lower surface 32 of the insulator 30 is configured to rest upon the upper portion 23 of the reflector assembly 22. Likewise, the lower surface 42 of the warming blanket 40 is configured to rest upon the upper surface 31 of the insulator 30 such that the insulator 30 is sandwich between the warming blanket 40 and the reflector assembly 22.

In embodiments that include the insulator 30, the insulation material 34 is selected to optimize the amount of waste heat W transferred from the reflector assembly 22 to the warming blanket 40. As previously discussed, selection of the insulation material 34 includes consideration of the level of waste heat W dissipated from the reflector assembly 22 in steady state condition, as well as the properties of the PCM 44 within the warming blanket 40. In this manner, both the insulation material 34 and the PCM 44 can be optimized to minimize the time to heat the warming blanket 40 to a desired maximum temperature, to prevent the maximum temperature from exceeding a threshold limit, or a combination of both.

While the present embodiments depict the reflector assembly 22 having an upper portion 23 in an arcuate formation, mirrored by the insulator 30 and warming blanket 40, other configurations are also anticipated by the present disclosure. For example, the upper portion 23 of the reflector assembly 22 may be substantially flat, whereby the insulator 30 and warming blanket 40 would also be configured to accommodate resting in substantially flat positions.

In certain embodiments, the window 18 in the overhead portion 10 is enclosed with a transparent material, such as glass. However, in other embodiments, the window 18 may be open or slidably openable to allow some level of waste heat W to escape from the overhead portion 10. In this manner, the caregiver may modulate the amount of heat received by the warming blanket 40 and the stored position within the overhead portion 10 to ensure that the warming blanket 40 does not exceed a threshold limit as indicated by the temperature module 50.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

We claim:

1. A warming device configured to warm an infant, the warming device comprising:

a base configured to support the infant;

an overhead portion that includes an enclosure;

an arm coupled to the base and to the overhead portion, wherein the arm supports the overhead portion above the base;

a heating element configured to generate a heat to warm the infant, wherein the overhead portion includes the heating element, and wherein a portion of the heat is dissipated into the overhead portion as a waste heat; and a warming blanket having a stored state and a deployed state, wherein in the stored state the warming blanket is at least partially inside the overhead portion, wherein in the deployed state the warming blanket is outside the overhead portion, wherein the warming blanket is configured to store the waste heat when the warming blanket is in the stored state, and wherein the warming blanket is configured to warm the infant when in the deployed state.

2. The warming device according to claim 1, further comprising a door in the overhead portion that opens and closes to provide access inside the overhead portion.

3. The warming device according to claim 2, further comprising a window in the overhead portion such that the warming blanket is viewable outside the overhead portion while the door is closed.

4. The warming device according to claim 1, wherein the overhead portion further comprises a reflector having an upper portion and a lower portion, wherein the upper portion faces the enclosure, wherein the lower portion faces the base, and wherein the heating element is between the upper portion and the base such that the upper portion of the reflector directs the heat generated by the heating element towards the base.

5. The warming device according to claim 4, wherein in the stored state the warming blanket is between the reflector and the enclosure.

6. The warming device according to claim 5, further comprising an insulator that is between the reflector and the enclosure, wherein in the stored state the warming blanket is between the insulator and the enclosure, and wherein the insulator reduces the waste heat that is dissipated from the reflector to the overhead portion.

7. The warming device according to claim 1, wherein the warming blanket further comprises a temperature sensor that measures a temperature of the warming blanket.

8. The warming device according to claim 7, wherein the warming blanket further comprises a display that indicates the temperature measured by the temperature sensor.

9. The warming device according to claim 1, wherein the warming blanket further comprises a first edge, a second edge that is opposite the first edge, and a fastener configured to removably couple the first edge to the second edge, wherein the warming blanket is configured to be wrapped around the infant, and wherein the fastener is configured to retain the warming blanket around the infant when the fastener is fastened.

10. The warming device according to claim 1, wherein the warming blanket includes a phase change material configured to store at least a portion of the waste heat.

11. A method for warming an infant, the method comprising:

providing a base configured to support the infant;

providing an overhead portion that includes an enclosure;

supporting the overhead portion above the base with an arm, wherein the arm is coupled to the base and to the overhead portion;

providing a heating element within the overhead portion, wherein the heating element is configured to generate heat to warm the infant, and wherein a portion of the heat is dissipated into the overhead portion as a waste heat; and providing a warming blanket that is positionable in a stored state and in a deployed state, wherein in the stored state the warming blanket is at least partially inside the overhead portion, wherein in the deployed state the warming blanket is outside the overhead portion, wherein the warming blanket is configured to store at least a portion of the waste heat when the warming blanket is in the stored state, and wherein the warming blanket is configured to warm the infant with the waste heat stored from the heating element when in the deployed state.

12. The method according to claim 11, further comprising providing a door in the overhead portion that opens and closes to provide access inside the overhead portion.

13. The method according to claim 12, further comprising providing a window in the overhead portion such that the warming blanket is viewable outside the overhead portion while the door is closed.

14. The method according to claim 11, wherein the overhead portion further includes a reflector having an upper portion and lower portion, further comprising configuring the reflector such that the upper portion faces the enclosure and the lower portion faces the base, and further comprising positioning the heating element between the upper portion and the base such that the reflector directs the heat generated by the heating element towards the base.

15. The method according to claim 14, wherein in the stored state the warming blanket is between the reflector and the enclosure.

16. The method according to claim 15, further comprising positioning an insulator between the reflector and the enclosure, wherein in the stored state the warming blanket is between the insulator and the enclosure, and wherein the insulator reduces the waste heat that is dissipated from the reflector to the overhead portion.

17. The method according to claim 11, further comprising providing a temperature sensor with the warming blanket and measuring with the temperature sensor a temperature of the warming blanket.

18. The method according to claim 17, further comprising providing a display with the warming blanket that indicates the temperature measured by the temperature sensor.

19. The method according to claim 11, wherein the warming blanket further comprises a first edge and a second edge that is opposite the first edge, further comprising providing a fastener configured to removably couple the first edge to the second edge, and further comprising fastening the first edge to the second edge to retain the warming blanket around the infant.

20. The method according to claim 11, further comprising fabricating the warming blanket to include a phase change material configured to store at least a portion of the waste heat.

* * * * *